US006614417B2

(12) United States Patent
Murade

(10) Patent No.: US 6,614,417 B2
(45) **Date of Patent: *Sep. 2, 2003**

(54) DRIVING CIRCUIT FOR ELECTROOPTICAL DEVICE, ELECTROOPTICAL DEVICE, AND ELECTRONIC APPARATUS

(75) Inventor: Masao Murade, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/202,847

(22) Filed: Jul. 26, 2002

(65) Prior Publication Data

US 2003/0001831 A1 Jan. 2, 2003

Related U.S. Application Data

(63) Continuation of application No. 09/511,072, filed on Feb. 23, 2000, now Pat. No. 6,448,953.

(30) Foreign Application Priority Data

Feb. 23, 1999 (JP) ..... 11-044986
Feb. 9, 2000 (JP) ..... 2000-31745

(51) Int. Cl.[7] ..... G09G 3/36
(52) U.S. Cl. ..... 345/98; 345/100; 345/204
(58) Field of Search ..... 345/98, 99, 100, 345/204, 87, 88, 89, 205, 206

(56) References Cited

U.S. PATENT DOCUMENTS 5,028,916 A 7/1991 Ichikawa et al. ..... 345/98
5,801,673 A 9/1998 Shimada et al. ..... 345/100
6,049,321 A 4/2000 Sasaki ..... 345/99
6,448,953 B1 * 9/2002 Murade ..... 345/98

FOREIGN PATENT DOCUMENTS

JP 09-269754 A 11/1993
JP 05-303080 A 10/1997
JP 10-198315 A 7/1998
JP 10-307543 A 11/1998
JP 2000-031745 11/2000

* cited by examiner

*Primary Examiner*—Xiag Wu
(74) *Attorney, Agent, or Firm*—Oliff & Berridge, PLC

(57) ABSTRACT

The invention provides for the efficient use a substrate region in a liquid crystal device with built-in driving circuits which simultaneously drives a plurality of data lines, etc. One of substrates used for the liquid crystal device may include a plurality of latch circuits for sequentially outputting transfer signals, buffer circuits for outputting sampling-control signals via signal lines by performing wave shaping on the transfer signals input via wires, and sampling switches for sampling, in accordance with the sampling-control signals, video signals supplied to video-signal lines, and for supplying the sampled signals to the corresponding data lines. The buffer circuits each comprise inverters connected in series in three stages in a direction in which the data lines extend, and the inverter in each stage comprise seven inverters connected in parallel in a direction intersecting the extended direction of the data lines.

28 Claims, 12 Drawing Sheets

DRIVING CIRCUIT FOR ELECTROOPTICAL DEVICE, ELECTROOPTICAL DEVICE, AND ELECTRONIC APPARATUS

This is a Continuation of Application No. 09/511,072 filed Feb. 23, 2000. The entire disclosure of the prior application is hereby incorporated by reference herein in its entirety now U.S. Pat. No. 6,448,953.

BACKGROUND OF THE INVENTION

1. Field of Invention

The present invention relates to a driving circuit for an electrooptical device in which the driving circuit performs high definition display while preventing an unnecessary region from being generated in a formation region, to the electrooptical device including the driving circuit, and to an electronic apparatus using the electrooptical device.

2. Description of Related Art

A driving circuit for a conventional electrooptical device, for example, a liquid crystal device, includes a data-line driving circuit, a scanning-line driving circuit, and a sampling circuit that supply video signals, scanning signals, etc., with predetermined timing, to data lines, scanning lines, etc., provided in an image display region. Among the circuits, the data-line driving circuit includes, in general, a plurality of latch circuits (shift-register circuit), and outputs sampling-control signals by sequentially shifting transfer signals supplied in the beginning of a horizontal scanning period in accordance with a clock signal. The scanning-line driving circuit similarly includes a plurality of latch circuits, and outputs a scanning signal by sequentially shifting transfer signals supplied in the beginning of a vertical scanning period in accordance with a clock signal. The sampling circuit, which includes sampling switches provided corresponding to the data lines, samples externally supplied video signals in accordance with sampling-control signals, and supplies the sampled signals to the data lines.

Also, a construction is employed that provides buffer circuits between latch circuits and a sampling circuit so that transfer signals are processed by wave shaping to generate the sampling-control signals and that can sufficiently cope with a load on the sampling switches, even if the driving ability of the latch circuits is insufficient for driving sampling switches.

In addition, an electrooptical device with built-in driving circuits has been developed in which the above-described driving circuits are provided on a substrate included in the electrooptical device. In this type of electrooptical device, devices constituting the driving circuits are fabricated in a common process, with switching devices, in view of, for example, increasing the efficiency of the fabrication process. For example, in a liquid crystal device using liquid crystal as an electrooptical material, devices constituting driving circuits include thin-film transistors (hereinafter referred to as "TFTs") which drive liquid crystal pixels. This type of electrooptical device with built-in driving circuits are advantageous in achieving a reduction in the overall size and cost reduction, compared with a type of electrooptical device in which driving circuits, formed on a separate substrate, are externally provided.

Recently, not only in electrooptical devices but also in display units in general, high definitions, such as XGA (1024×768 dots), SXGA (1280×1024 dots), and UXGA (1600×1200 dots) standards, are in great demand. In accordance with the demand, it is required that a dot frequency in an electrooptical device be increased. When the dot frequency is increased in the type of electrooptical device with built-in driving circuits, insufficiency in the sampling performance of sampling switches, delays in the operations of devices constituting the driving circuit, etc., occur, so that, by way of example, as a result of writing, video signals that must originally be written in the next data line, as well as in the previous data line, a so-called "ghost" or "crosstalk" is generated, reducing the definition of a displayed image. As a solution, the performance itself of the sampling switches and devices constituting the driving circuits can be enhanced, but this results in a remarkable increase in the cost.

Accordingly, a technique has recently been developed in which video signals on a route are distributed to a plurality of routes while being expanded (serial-to-parallel converted) in a time domain and in which a sampling circuit simultaneously samples video signals on a plurality of routes and simultaneously supplies the sampled signals to a plurality of data lines. According to this technique, in accordance with the number of data lines being simultaneously driven, the sampling time of each sampling switch is multiplied by the number of data lines being simultaneously driven. Thus, a driving frequency in a driving circuit decreases substantially with the reciprocal of the number of data lines being simultaneously driven. Therefore, it is possible to cope with an increased dot frequency without improving the performance of the sampling switches, devices constituting driving circuits, devices for driving pixels, etc.

In the case where a plurality of data lines are simultaneously driven as described above, it is required that a plurality of sampling switches be supplied with sampling-control signals at the same time or of the same type. Accordingly, it is required that the driving ability of buffer circuits provided between latch circuits and the sampling switches be enhanced in accordance with a total load on the sampling switches.

Concerning measures for enhancing the driving ability of the-buffer circuit, it is possible that logic circuits constituting the buffer circuit, for example, devices constituting an inverter, be enlarged in size. In the measures, simple enlargement of the component devices generates the need for enhancing the driving ability of the latch circuit, causing a result which contradicts a general demand in the technical field of the electrooptical device, such as reduction in power consumption of the shift-register circuit including a plurality of latch circuits. Accordingly, a construction is employed in which a buffer circuit is formed by connecting a plurality of inverters in series so as to have a plurality of stages, whereby the driving ability of the buffer circuit is enhanced step-by-step in each stage. In other words, a construction is employed in which the size of devices constituting inverters in stages on the side of the latch circuits is small and in which the size of devices constituting inverters on the side of the sampling switches is large.

If each buffer circuit including inverters connected in series so as to have a plurality of stages is provided in the above-described electrooptical device with built-in driving circuits, each buffer circuit is enlarged in a substrate region, so that a problem occurs in that an area occupied by each buffer circuit and an ineffectively used area increase. In particular, since a region in which the buffer circuits are formed is normally a region provided between video-signal lines and a shift-register circuit, it is longitudinal in a direction intersecting with a direction in which data lines extend. Accordingly, in a simple construction in which inverters in each stage are formed from devices longitudinally extending along the direction in which data lines extend and in which the inverters are connected in series so as to have a plurality of stages, the proportion of an ineffectively used area of the region is remarkably large. Finally, a data-line driving circuit is formed in an outermost part of an image-display region. Thus, a non-image-display region expands, causing a result contradicting general demands on the electrooptical device, such as size and weight reduction of the entire electrooptical device, and enlargement of an image display region in the same device size.

SUMMARY OF THE INVENTION

The present invention provides a driving circuit for an electrooptical device including the driver circuit, such as a liquid crystal device simultaneously driving a plurality of data lines in which the driving circuit efficiently uses a substrate region to enable reduction in the size of the entire electrooptical device, an electrooptical device including the driving circuit, and an electronic apparatus including the electrooptical device.

To achieve the foregoing, the present invention provides a driving circuit for an electrooptical device including, on a substrate, a plurality of scanning lines, a plurality of data lines, switching devices connected to the scanning lines and the data lines, and pixel electrodes connected to the switching devices. The driving circuit may include on the substrate, a shift-register circuit including a plurality of latch circuits for sequentially outputting transfer signals, buffer circuits provided corresponding to output stages of the shift-register circuit with each consisting of two or more logic circuits connected in parallel along a direction intersecting a direction in which the data lines extend and outputting the transfer signals as sampling-control signals, and sampling switches connected to the data lines provided for sampling video signals in accordance with the sampling-control signals and for supplying the sampled signals to the corresponding data lines, among which a plurality of sampling switches connected to a plurality of adjacent data lines are simultaneously driven.

According to the present invention, sampling-control signals are simultaneously supplied to p sampling switches connected to a plurality of (here described as "p" for convenience) adjacent data lines. At this time, transfer signals are sequentially output by a shift-register circuit, and the transfer signals are output as the sampling-control signals via buffer circuits. Video signals are sampled in accordance with the sampling-control signals by the sampling switches, and the sampled signals are supplied to the p data lines. Since the p sampling switches are simultaneously driven as described above, the driving of the data lines is facilitated, even for video signals having a high dot frequency.

The sampling-control signals are supplied corresponding to each group of p sampling switches. Thus, each buffer circuit may be provided for each latch circuit in the shift-register circuit, not with the pitch of the data lines but with a pitch p times the pitch of the data lines. Accordingly, in a region in which buffer circuits are formed, length in a direction intersecting the data lines is sufficiently reserved, compared with a conventional method of driving the sampling switches one by one. Since two or more logic circuits constituting the buffer circuits are connected in parallel in the direction intersecting the data lines, efficient use of the substrate region and an increase in the driving ability are achieved. The logic circuits each in the present invention include not only a single circuit, such as an inverter, a buffer, or a NAND gate, but also a circuit obtained by combining two or more single circuits as described.

In the present invention, it is preferable that transistors constituting the logic circuits have a width direction formed in a direction in which the data lines extend. The driving ability of a buffer circuit is, in general, determined by the size of a transistor constituting the buffer circuit, particularly by channel width. However, in the present invention, a transistor is formed so that the channel width direction of the transistor is the direction in which the data lines extend. Thus, relatively easy reservation of necessary channel width can be performed.

In this construction, it is preferable that, among two or more logic circuits connected in parallel, adjacent logic circuits share one of a plurality of power-supply wires. This is because this arrangement efficiently uses the substrate region in connection with sharing. Concerning the sharing of one of a plurality of power-supply wires, the arrangement can easily be formed by disposing adjacent logic circuits so as to be symmetrical around the shared power-supply wire. This is effective particularly in the case where a logic circuit comprises a complementary transistor, as described below.

In the present invention, in the region where the buffer circuits are formed, length in the direction intersecting the data lines is sufficiently reserved, compared with the conventional method of driving the sampling switches one by one. However, the length is determined by almost only the number p of the sampling switches simultaneously driven. The number of logic circuits connectable in parallel in a stage cannot be increased without limitation. Accordingly, in the present invention, it is preferable that the buffer circuits be formed by connecting in series two or more logic circuits connected in parallel so as to have a plurality of stages in the direction in which the data lines extend. With this construction, the driving ability of the buffer circuits can be enhanced, achieving efficient use of the substrate region.

In addition, in this condition, it is preferable that the channel width of transistors constituting logic circuits in one stage be broader than the channel width of transistors constituting logic circuits in the previous stage. With this construction, the driving ability of the entire buffer circuits can be enhanced since the sizes of transistors constituting the logic circuits increase step by step corresponding to stages. Accordingly, the number of samplings that can be simultaneously driven can be increased. Since transistors that constitute logic circuits in the first stage may have a relatively small size, latch circuits for supplying the transistors with transfer signals may have driving ability. Therefore, for a shift-register circuit including a plurality of latch circuits, its circuit size is reduced and reduced power consumption is achieved.

As the number of stages connected in series increases, a total of delay periods caused by transistors constituting the logic circuits increases. Accordingly, it is actually preferable that the number of stages connected in series be determined so that the total of delay periods finally affects a displayed image and so that a dot frequency, necessary specifications, image definition, etc., are comprehensively considered.

In the arrangement connected in series, it is preferable that the numbers of logic circuits connected in parallel in all the stages be equal. With this arrangement, the logic circuits are arranged in the form of a matrix in the direction in which the data lines extend, so that designing in the buffer circuits is facilitated. By connecting, in parallel, logic circuits to the limit in each stage in the direction intersecting the direction in which the data lines extend, the substrate region can be used to the limit.

In an arrangement in which logic circuits are arranged in the form of a matrix, it is preferable that, among the logic circuits in all the stages, logic circuits in the same stage mutually share power-supply wires formed in the direction in which the data lines extend. With this construction, not only the design of the buffer circuits is facilitated but also the substrate region is effectively used in connection with the shared power-supply wires. In order that a power-supply wire is shared by logic circuits positioned in the same stage, two power-supply wires can be disposed so as to be opposed to each other in the form of comb teeth. In particular, in this arrangement, among logic circuits in the same row, one of a plurality of power-supply wires is shared by adjacent logic circuits, which greatly simplifies the wiring of power-supply wires.

It is preferable that each logic circuit in the driving circuit according to the present invention comprises a complementary transistor. This can increase the input impedance of each logic circuit using the complementary transistor, and can drive each high-loaded sampling switch via the complementary transistor, based on transfer signals from each latch circuit having small driving ability.

It is preferable that the driving circuit according to the present invention further comprises a phase-adjusting circuit which restricts the signal width of the transfer signal from each latch circuit to a predetermined period and which supplies the restricted signal to each buffer circuit. Thereby, the phase-adjusting circuit restricts the signal width (time in which the signal is at an active level) of each transfer signal to a predetermined period, whereby overlapping of transfer signals closely output from the latch circuits is reduced. This prevents the simultaneous sampling of the same video signals in data lines that must be driven by different sampling-control signals, whereby the generation of crosstalk and ghosts is suppressed beforehand.

In the driving circuit according to the present invention, it is preferable that, on the substrate, a plurality of video-signal lines for supplying the video signals are arranged along the scanning lines, and that the buffer circuits be formed between the video-signal lines and the shift-register circuit. Thereby, the buffer circuits are formed in a region on the substrate between a plurality of video-signal lines and the shift-register circuit. Thus, the logic circuits are connected in parallel in a laterally long region along the video-signal lines and the scanning lines. As a result, efficient use of the substrate region and enhancement of driving ability are achieved.

In the driving circuit according to the present invention, it is preferable that the video signals be serial-to-parallel converted and supplied via the video-signal lines. Thereby, the video signals are converted onto a plurality of routes, which generates substantial clearance in the time domain. Thus, sampling switches having relatively low ability can be used, even for a high dot frequency.

To achieve the foregoing, the present invention provides an electrooptical device including the above-described driving circuit. According to the present invention, by achieving efficient use of the substrate enables size reduction in the entire device, a high-definition display, with enlargement of an image-display region in the same-sized device.

Here, it is preferable that the present invention include on the substrate, the pixel electrodes, which are arranged in the form of a matrix, and transistors provided between the pixel electrodes and the data lines that are switched on and off in accordance with scanning signals supplied to the scanning lines. This construction can electrically separate on-pixels and off-pixels by using transistors, whereby a high-definition and highly fine display having a high contrast and no crosstalk, is realized.

Moreover, to achieve the foregoing, the present invention provides an electric apparatus including the above-described electrooptical device, whereby a high-definition display having no ghosts and no crosstalk is realized.

DETAILED DESCRIPTION OF PREFERRED EMBODIMENTS

Embodiments of the present invention are described below with reference to the drawings.

Figure 1:
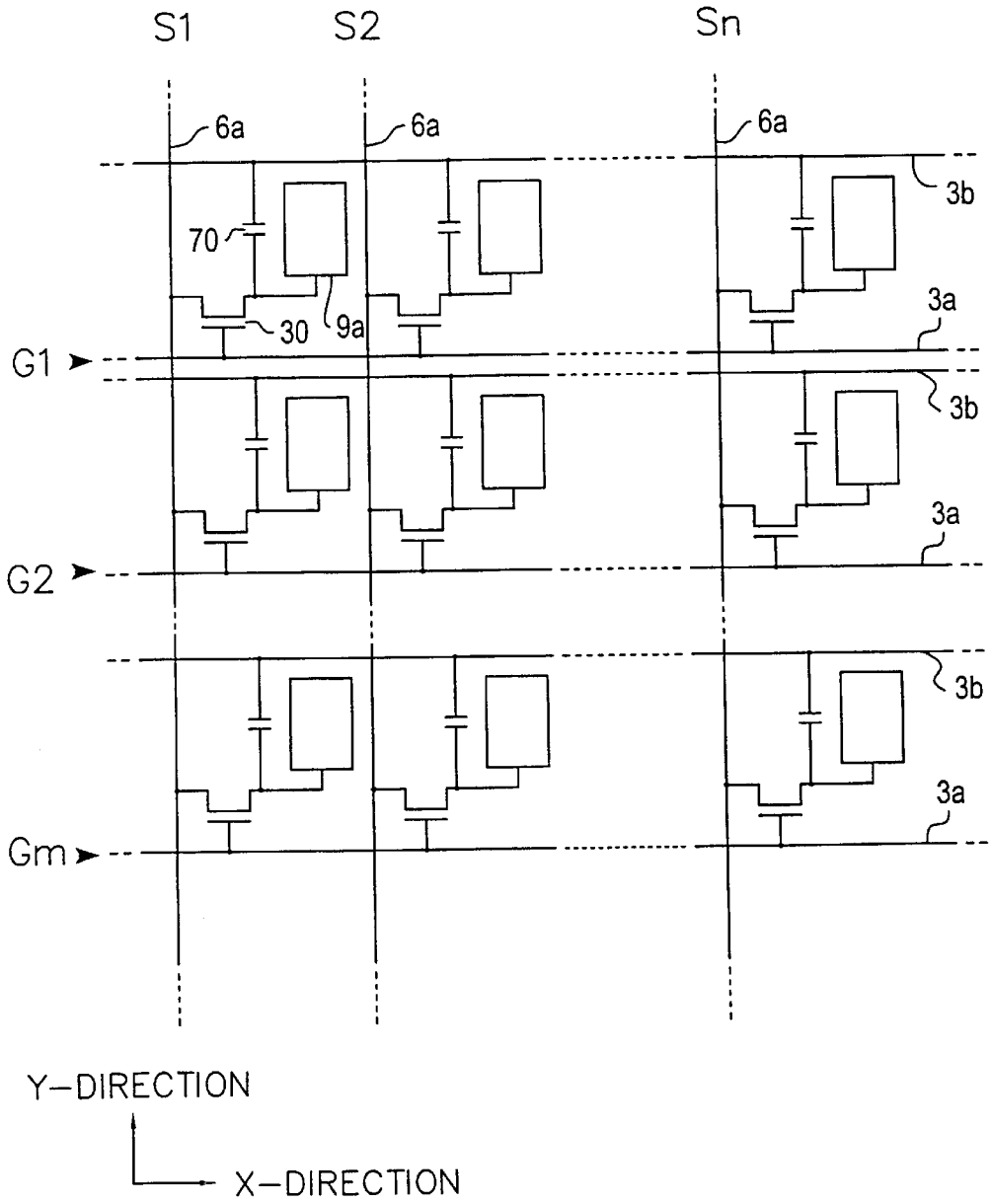
FIG. 1 is an equivalent circuit diagram showing an image display region in a TFT-array substrate constituting a liquid crystal device according to an embodiment of the present invention.

At first, a liquid crystal device as an embodiment of an electrooptical device according to the present invention is described. The liquid crystal device is constructed, as described below, such that a TFT array substrate and a counter substrate are joined so that their electrode-formed surfaces are opposed to each other, with a constant gap maintained and liquid crystal provided in the gap. Among these components, the image-display region of the TFT array substrate is an equivalent circuit as shown in FIG. 1.

As shown in this figure, m scanning lines 3*a* are formed to be arranged in parallel along an X-direction, and n data lines 6*a* are formed to be arranged in parallel along a Y-direction. At points where the scanning lines 3*a* and the data lines 6*a* cross, the gates of TFTs 30 are connected to the scanning lines 3*a*, the sources of the TFTs 30 are connected to the data lines 6*a*, and the drains of the TFTs 30 are connected to pixel electrodes 9*a*. Pixels are formed by pixel electrodes 9*a*, a counter electrode (described below) formed on the counter substrate, and the liquid crystal provided between both electrodes. As a result, the pixels are arranged in the form of a matrix so as to correspond to the points where the scanning lines 3*a* and the data lines 6*a* cross.

In the liquid crystal device according to this embodiment, video signals S1, S2, . . . , and Sn sampled to the data lines 6*a* are signals distributed to 12 routes after serial-to-parallel conversion performed beforehand by a serial-to-parallel conversion circuit (representation omitted) in an video-signal processing circuit for supplying the liquid crystal device with the video signals S1, S2, . . . , and Sn, in which the signals are simultaneously supplied corresponding to each group composed of 12 adjacent data lines 6*a*. In general, the number of serial-to-parallel conversions may be set to, for example, a small value such as "3" or "6" when a dot frequency is relatively low (or sampling ability in the sampling circuit described below is relatively high). Conversely, it may be set to, for example, a large value, such as "24" when the dot frequency is relatively high (or sampling ability is relatively low). It is preferable that the number of serial-to-parallel conversions be a multiple of 3 in that control and circuit arrangement for performing video display is simplified, from a relationship in which a color video signal consists of signals relating to three colors. In addition, for high dot frequencies in XGA, SXGA, UXGA, etc., of nowadays, it is preferable to set the number of serial-to-parallel conversions to a large value such as "12" in this embodiment or "24" in view of the current TFT manufacturing technique.

To the scanning lines 3*a* to which the gates of the TFTs 30 are connected, scanning signals G1, G2, . . . , and Gm are applied in the form of pulses by line-at-a-time scanning. Accordingly, when a scanning signal is supplied to one scanning line 3*a*, the TFT 30 connected to the one scanning line 3*a* is switched on. Thus, the video signals S1, S2, . . . , and Sn supplied with predetermined timing from the data lines 6*a* are maintained for a predetermined period after being sequentially written in the corresponding pixels.

Here, the orientation and order of liquid crystal molecules change in accordance with a voltage level applied to each pixel, which thus enables gray scale display by optical modulation. For example, the amount of light passing through the liquid crystal gets limited as the applied voltage increases in a normally white mode, while it gets relaxed as the applied voltage increases in a normally black mode. Thus, in the liquid crystal device, as a whole, light having a contrast in accordance with a video signal is emitted from each pixel. This enables a predetermined display.

In order to prevent the maintained video signals from leaking, each storage capacitor 70 is added in parallel to each liquid crystal capacitor formed between each pixel electrodes 9*a* and the counter electrode. For example, the voltage of each pixel electrode 9*a* is maintained for a three-digit longer time than a source-voltage-applied time. Thus, as a result of improvement in maintaining characteristics, a high contrast ratio is realized.

Figure 2:
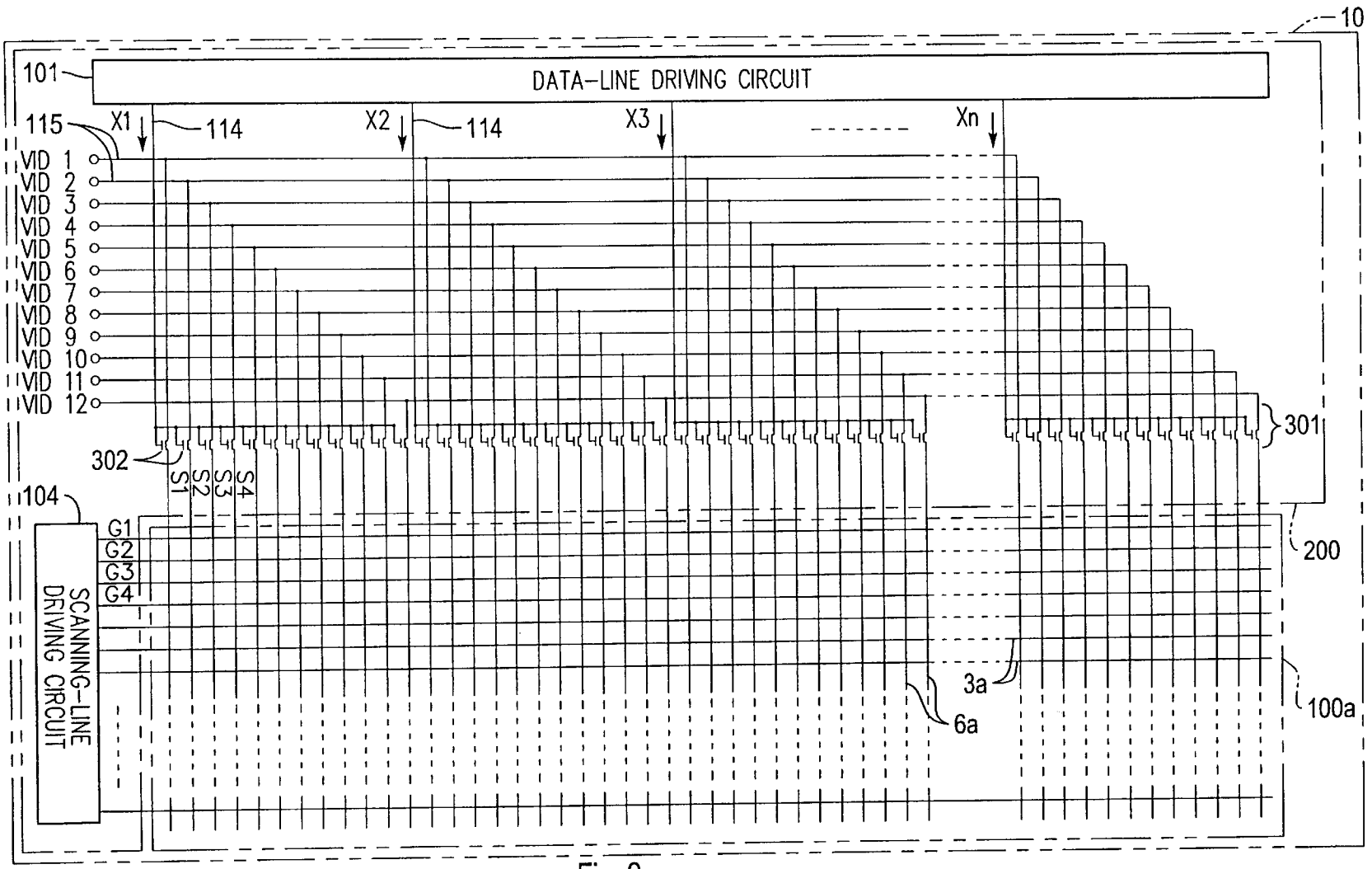
FIG. 2 is a block diagram showing a construction of the TFT-array substrate in the liquid crystal device.

Next, a driving circuit for the liquid crystal device according to this embodiment is described. FIG. 2 is a block diagram showing a construction of the TFT array substrate, in particular, an arrangement of a driving circuit formed in the periphery of the image-display region.

As shown in this figure, on a TFT array substrate 10, an image display area 100*a* as a region where the scanning lines 3*a* and the data lines 6*a* cross is provided, and a driving circuit 200 including a data-line driving circuit 101, a scanning-line driving circuit 104, and a sampling circuit 301 is provided. In other words, this embodiment is a TFT-active-matrix liquid-crystal device with built-in driving circuits, in which the driving circuit 200 is formed on the TFT array substrate 10.

In the driving circuit 200, the scanning-line driving circuit 104 supplies, in one vertical scanning period, scanning signals G1, G2, . . . , Gm to scanning lines 3*a* in the form of pulses by line-at-a-time scanning. The data-line driving circuit 101 sequentially supplies sampling-control signals X1, X2, . . . , Xn to sampling-control signal lines 114 in one horizontal scanning period, i.e., a period in which the scanning line driving circuit 104 is supplying a scanning signal to one scanning line 3*a*.

The sampling circuit 301, which includes sampling switches 302 corresponding to every data lines 6*a*, samples video signals supplied to video-signal lines 115 according to the sampling control signals X1, X2, . . . , Xn, and supplies the sampled signals to the corresponding data lines 6*a*. In this embodiment, video signals on one route are serial-to-parallel converted into video signals VID1 to VID12 on 12 routes, as described above. Thus, twelve sampling switches 302 connected to twelve adjacent data lines 6*a* are simultaneously driven by the same sampling-control signal, whereby the video signals VID1 to VID12 are sampled and supplied to the twelve data lines 6*a*.

Figure 3:
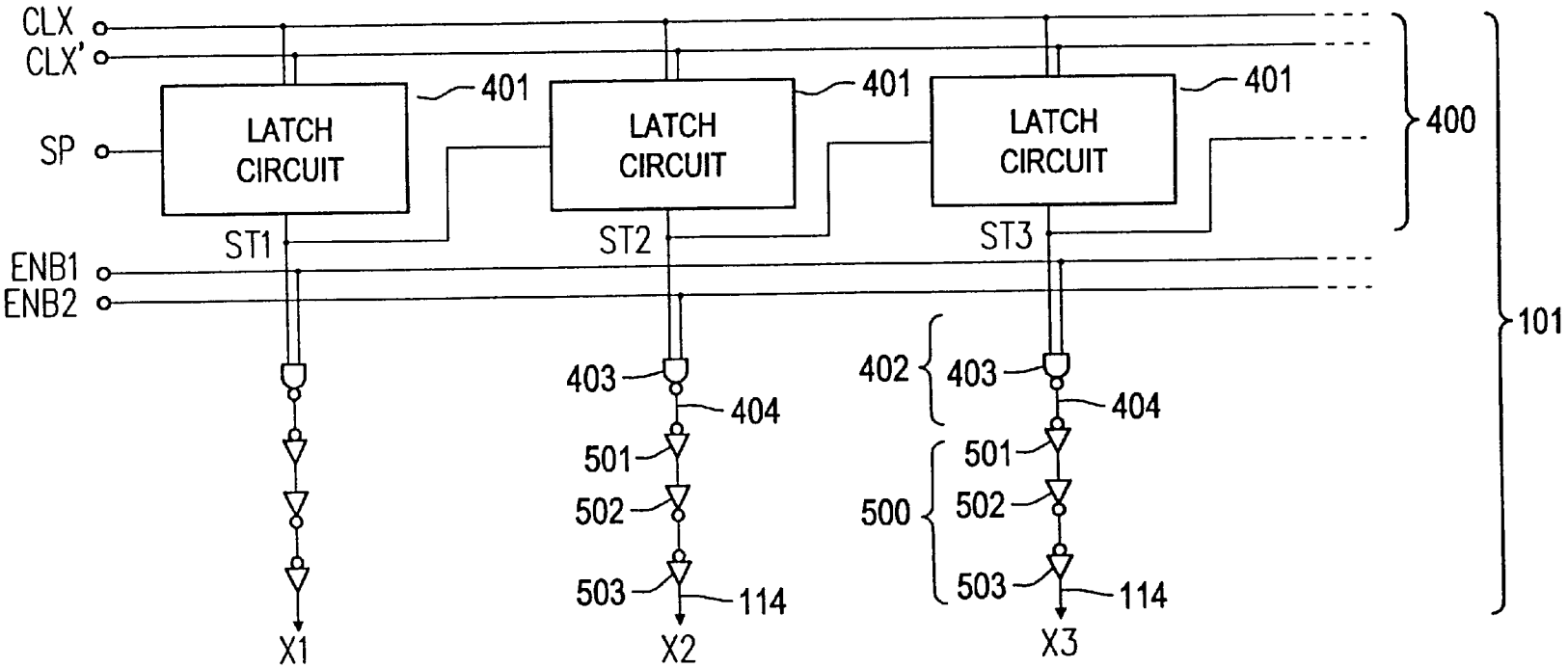
FIG. 3 is a block diagram showing a detailed construction of a data-line driving circuit in the liquid crystal device.

Next, the details of the data-line driving circuit 101 are described. FIG. 3 is a block diagram showing the structure of the data-line driving circuit 101. As shown in FIG. 3, the data-line driving circuit 101 includes a shift-register circuit 400 for sequentially outputting transfer signals, and buffer circuits 500 for performing wave shaping on the sequentially output transfer signals. Among these, the shift-register circuit 400 includes latch circuits 401 in a plurality of stages, which are connected in series. As each latch circuit 401, a delay flip-flop circuit that captures and maintains an input signal in accordance with a clock signal CLX and its inverted signal CLX', etc., is used.

In the data-line driving circuit 101, phase-adjusting circuits 402 are provided. The phase-adjusting circuits 402 consist of NAND circuits 403 provided corresponding to outputs from the latch circuits 401. Among these, a NAND circuit 403 in an odd-numbered stage from the left in this figure supplies a negative-logical-multiplication signal of a transfer signal $ST_{2i-1}$ (where i is a natural number) input from the corresponding latch circuit 401 and a phase-adjustment signal ENB1 to a buffer circuit 500 via a wire 404, and a NAND circuit 403 in an even-numbered stage from the left supplies a negative-logical-multiplication signal of a transfer signal $ST_{2i}$ input from the corresponding latch circuit 401 and a phase adjustment signal ENB2 to a buffer circuit 500 via a wire 404.

Each buffer circuit 500, which is provided for each NAND circuit 403, consists of three-stage inverters 501 to 503 connected in series, and outputs a sampling-control signal via each sampling-control signal line 114 by performing wave shaping on an output signal by each phase-adjusting circuit 402. Since the inverters 501 to 503 are formed so that the size of a TFT constituting each inverter gets larger in a further back stage, the buffer circuit 500 has, as a whole, a high driving ability and an input impedance reduced to be low.

Figure 4:
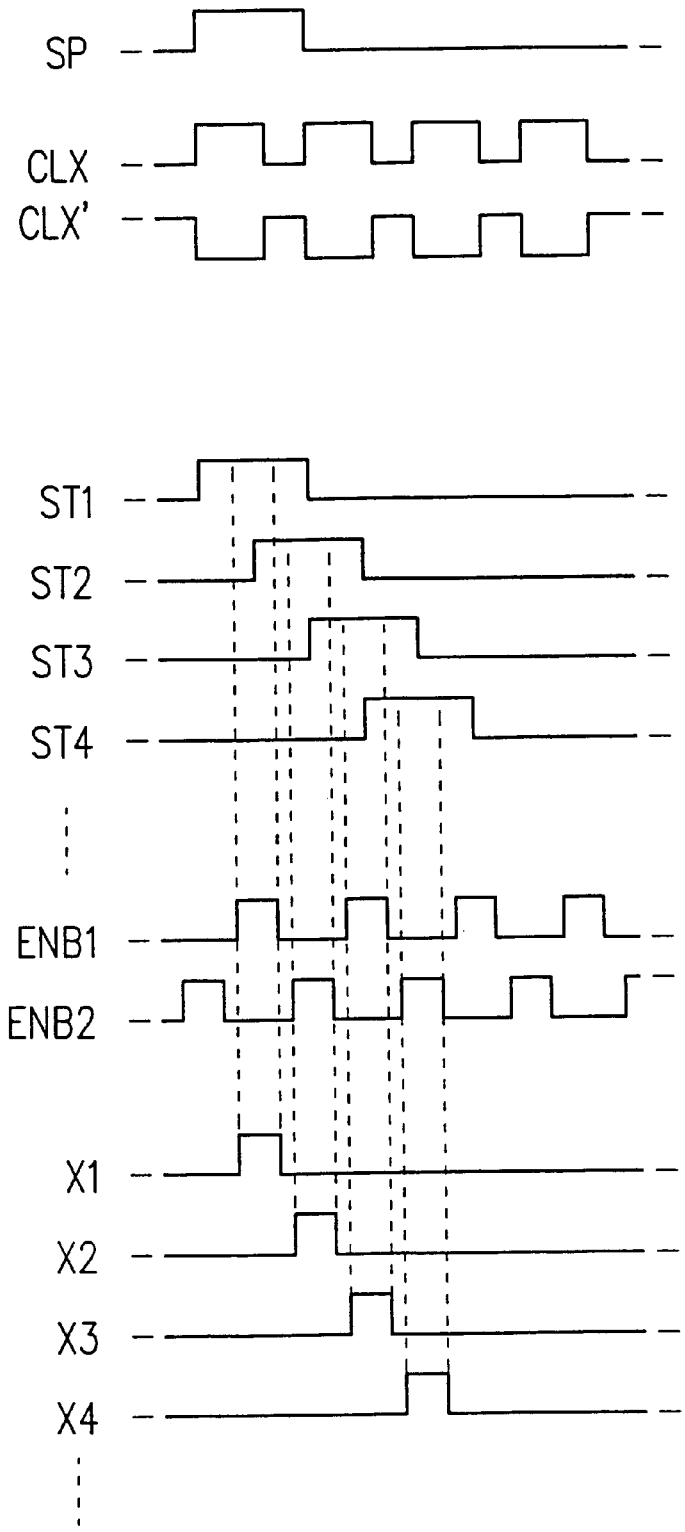
FIG. 4 is a timing chart showing the operation of the data-line driving circuit in the liquid crystal device.

Next, the operation of the data-line driving circuit 101 having the above-described construction is described. FIG. 4 is a timing chart illustrating the operation of data-line driving circuit 101. When a start pulse SP is supplied in synchronization with the video signals VID1 to VID12 by an external video-signal processing circuit in the beginning of one horizontal scanning period, as shown in this figure, the latch circuit 401 at the leftest position in FIG. 3 initiates a transfer operation based on an X-side reference clock signal CLX (and its inverted clock signal CLX'), thereby outputting and supplying a transfer signal ST1 to the latch circuit 401 in the second stage from the left. Next, the latch circuit 401 in the second stage outputs a transfer signal ST2 by shifting the transfer signal ST1 by a half period of the clock signal CLX, and supplies the transfer signal to the latch circuit 401 in the third stage from the left. Subsequently, as a result of similar transferring operations repeatedly performed by the latch circuits 401, transfer signals ST1, ST2, . . . , STn are sequentially output in one horizontal period.

After the sequentially output transfer signals ST1, ST2, . . . , STn are restricted to the pulse width of a phase-adjustment signal ENB1 or ENB2 by the phase-adjusting circuits 402, they are processed by wave shaping in the buffer circuits 500, and the shaped signals are supplied as sampling-control signals X1, X2, . . . , Xn to the sampling circuit 301, which is formed by transistors, etc.

In this embodiment, in particular, restriction of pulse width by the phase-adjusting circuits 402 causes pulse intervals of the sampling-control signals X1, X2, . . . , Xn, which are adjacent, to be discrete in time. Thus, the generation of crosstalk, ghosts, etc., caused by overlapping of these signal pulses, can be prevented beforehand. In other words, when the sampling-control signals X1, X2, . . . , Xn overlap, video signals that should originally be sampled and supplied to a group of data lines are sampled and supplied to groups of data lines, which are adjacent to the group of data lines. Thus, crosstalk, ghosts, etc., are generated, reducing display quality. However, in this embodiment, the sampling-control signals X1, X2, . . . , Xn are output so that their pulses are discrete in time. Thus, the generation of crosstalk, ghosts, etc., is prevented beforehand.

In addition, the driving ability of the latch circuits 401 and the phase-adjusting circuit 402 is even greater than the driving ability of the buffer circuits 500. Accordingly, even when the driving ability of the latch circuit 401 and the phase-adjusting circuit 402 is low, the twelve sampling switches 302 are preferably driven in the same time by the sampling-control signals X1, X2, . . . , Xn output from the buffer circuits 500.

Figure 5:
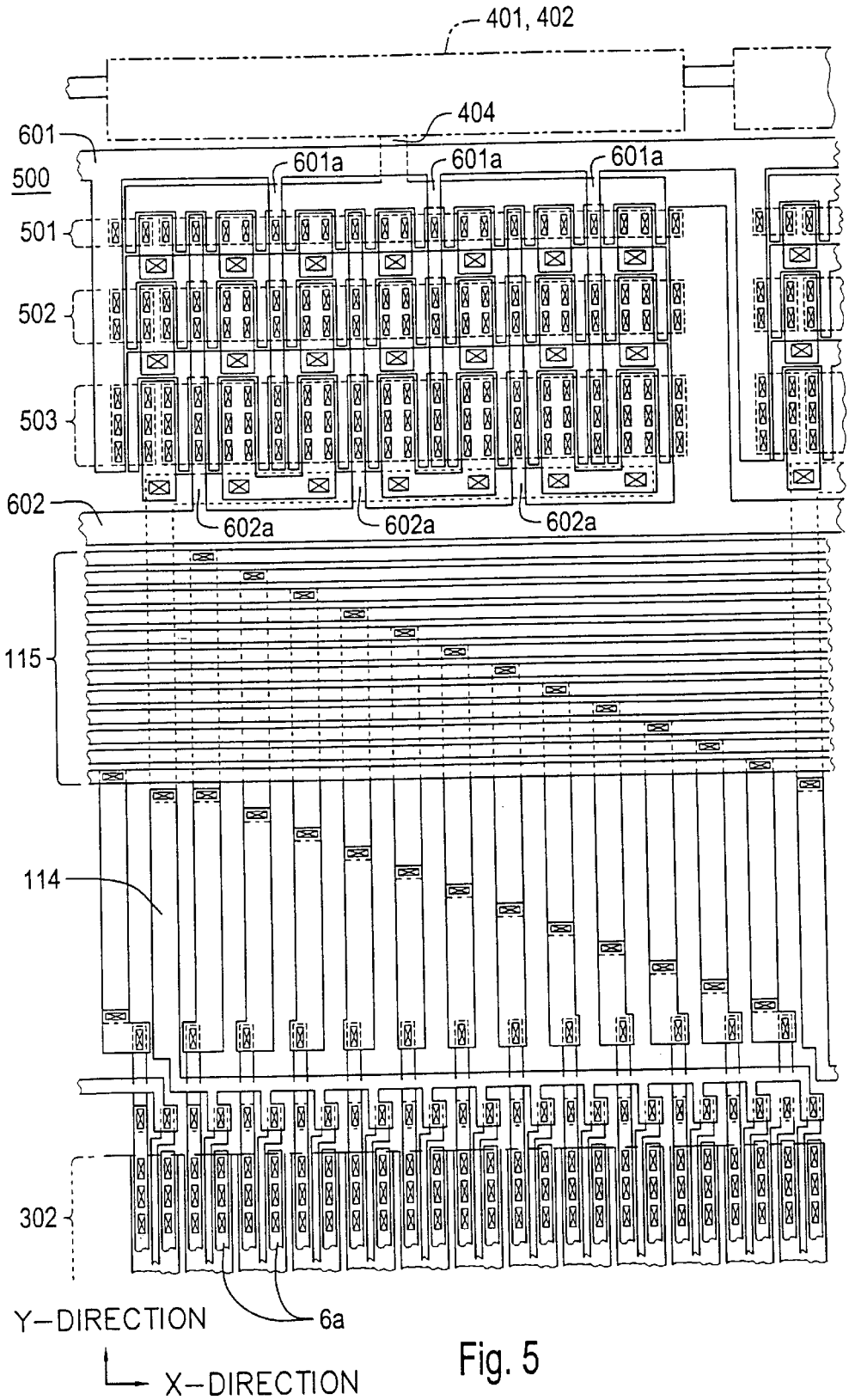
FIG. 5 is a plan view showing an arrangement of the data-line driving circuit in the liquid crystal device.

Here, an arrangement of the data-line driving circuit 101 is described. FIG. 5 is a plan view showing an arrangement of a main circuit of the data-line driving circuit 101. This figure shows that output signals from the phase-adjusting circuits 402, which are supplied via a wire 404, are firstly processed by wave shaping, etc., in the buffer circuits 500, whereby sampling-control signals are output via the sampling-control signal lines 114, and twelve sampling switches 302 are secondly controlled to be driven by the sampling-control signals, and that the video signals VID1 to VID12, supplied to twelve video signal lines 115, are sampled by the twelve sampling switches and supplied to twelve data lines 6*a* corresponding thereto. In addition, as shown in FIG. 5, the buffer circuits 500 are formed between the region where the latch circuits 401 and the phase adjusting circuits 402 are formed and the region where twelve video signal lines 115 supplied with the video signals VID1 to VID12 of the serial-parallel converted twelve routes are formed.

Figure 6:
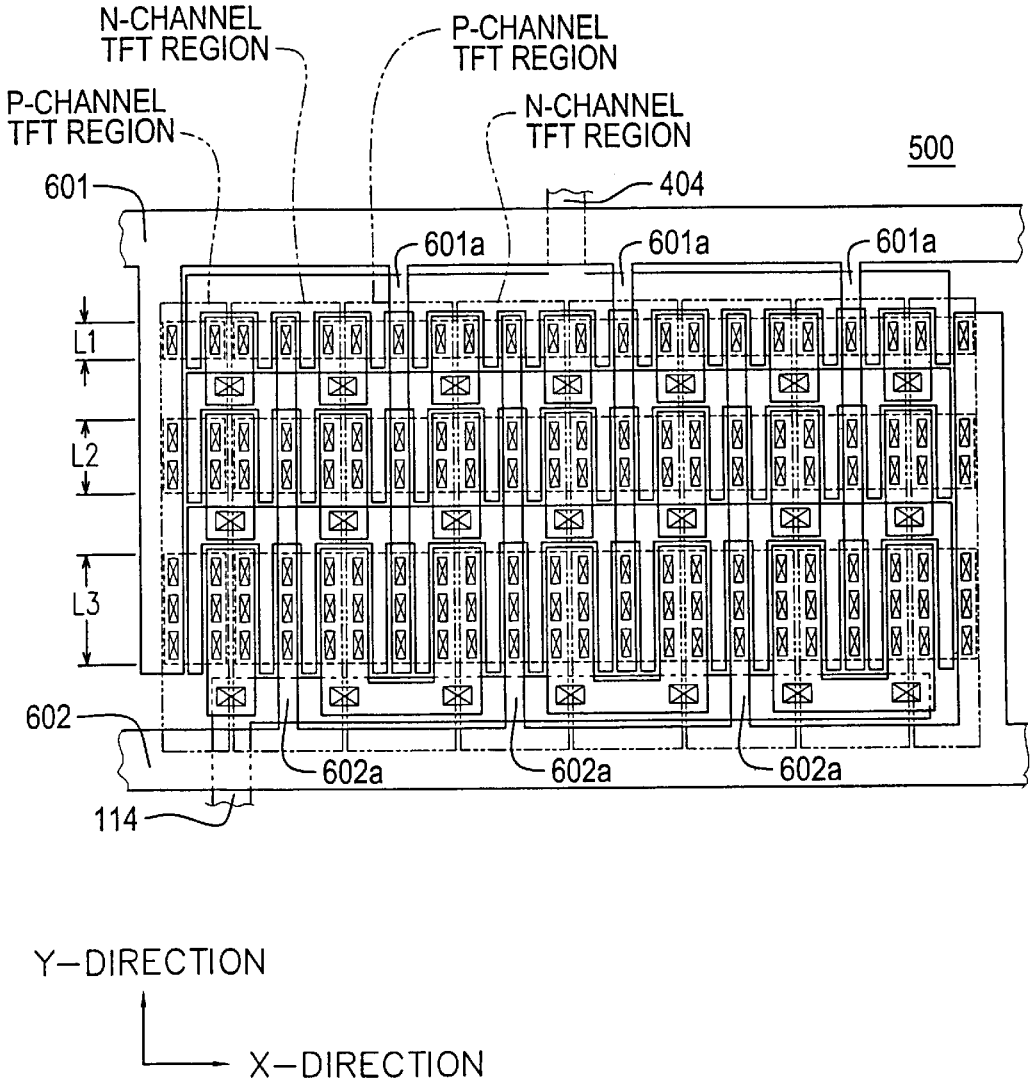
FIG. 6 is a plan view showing an arrangement of a buffer circuit in the liquid crystal device.
Figure 7:
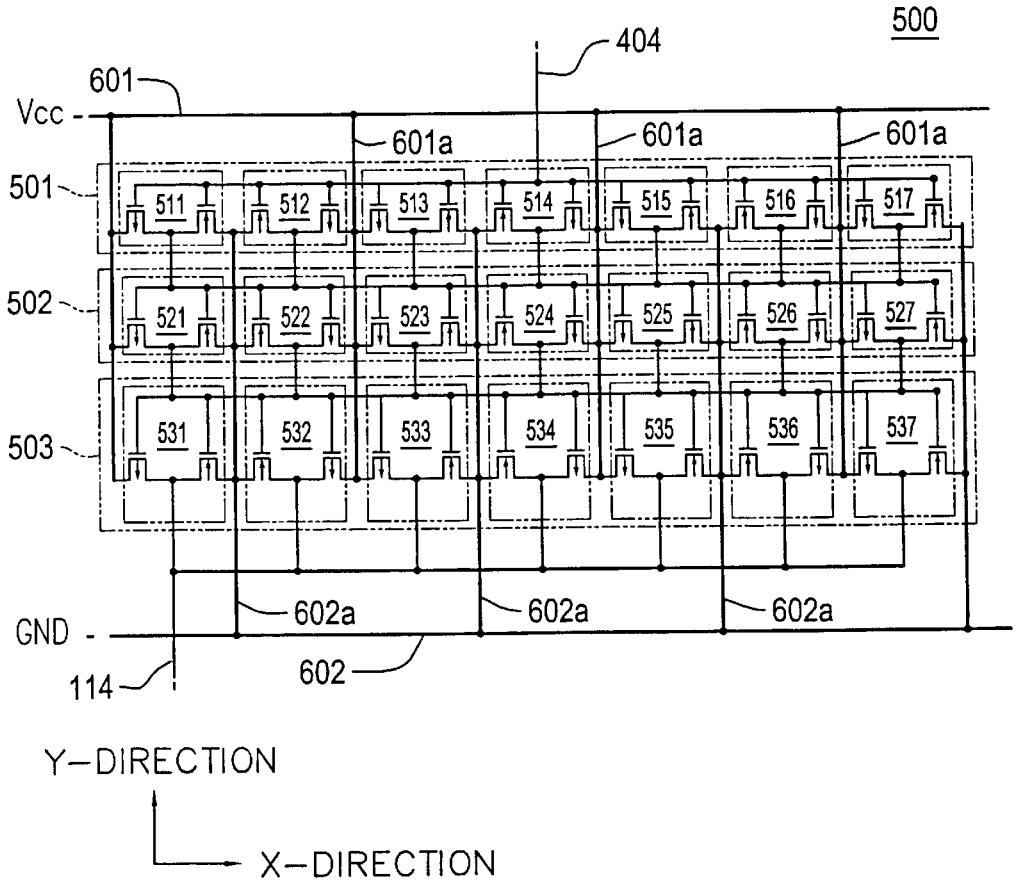
FIG. 7 is a detailed circuit diagram showing the buffer circuit in the liquid crystal device.
Figure 8:
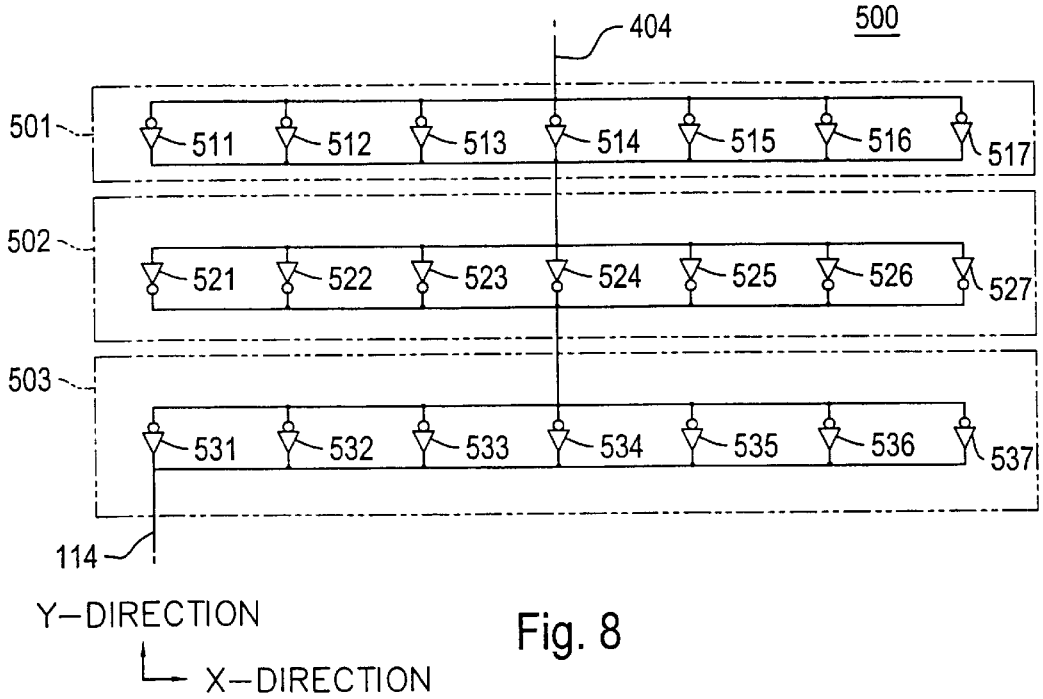
FIG. 8 is a detailed block diagram showing the buffer circuit in the liquid crystal device.

Next, the details of a buffer circuit 500 are described with reference to FIG. 6 to FIG. 8. FIG. 6 is a plan view showing an arrangement of the buffer circuit 500. FIG. 7 is a circuit diagram obtained by simplifying the arrangement in FIG. 6. FIG. 8 is an equivalent circuit diagram showing an arrangement of the buffer circuit 500. As shown in these figures, in the buffer circuit 500, three stages of inverters 501 to 503 are connected in series along a direction (Y-direction) where the data lines 6*a* extend, and in each stage of inverters 501 to 503, seven inverters are connected in parallel along a direction (X-direction) where the scanning lines 3*a* extend. In other words, the inverter in the first stage consists of inverters 511 to 517 connected in parallel, the inverter 502 in the second stage consists of inverters 521 to 527 connected in parallel, and the inverter in the third stage consists of inverters 531 to 537 connected in parallel.

These inverters 511 to 517, 521 to 527, and 531 to 537 are each formed as a complementary TFT obtained by combining a P-channel TFT and an N-channel TFT each having a channel width direction formed in the Y-direction. In other words, the inverters 511 to 517, 521 to 527, and 531 to 537 have P-channel TFTs and N-channel TFTs connected in series between lead wires 601*a* and 602*a*.

The channel widths of the TFTs are almost the same overall. Accordingly, the inverters 511 to 517, 521 to 527, and 531 to 537, which constitute the buffer circuit 500, has an arrangement in the form of a matrix of three rows by seven columns.

Here, among channel width L1 of TFTs constituting the inverter 501 (inverters 511 to 517) in the first stage, channel width L2 of TFTs constituting the inverter 502 (inverters 521 to 527) in the second stage, and channel width L3 of TFTs constituting the inverter 503 (inverters 531 to 537) in the third stage, L1 ƒL2 ƒL3 holds. As described above, the inverters 501 to 503 in the first stage to the third stage are each obtained by connecting the same number of (seven) inverters in parallel. Thus, the on-resistance is determined by the channel width, and inverter 501>inverter 502>inverter 503 holds.

Therefore, in the buffer circuit 500 as a whole, the input impedance is high, while the output impedance is low. This allows the use of the size of each TFT constituting the latch circuit 401, which outputs a transfer signal, or the phase-adjusting circuit 402, which narrows pulse width of the transfer signal. Thus, reduction in power consumption by the shift-register circuit 400, in which large power consumption is regarded as a problem, can be achieved, while a number of (twelve) sampling switches 302 are preferably controlled to be driven in the same time.

In addition, a high-voltage (Vcc) wire 601 and a low-voltage (GND) wire 602 are provided extending in the X-direction of the TFT-device array substrate 10, and particularly in a region in which the buffer circuit 500 is formed, lead wires 601*a* from the high-voltage wire 601, and lead wires 602*a* from the low-voltage wire 602, are provided extending in the Y-direction so as to be opposed to each other in the form of comb teeth, as indicated by the bold lines in FIG. 7.

Since the adjacent inverters in the X-direction share one channel region, and this pattern is successive, the channel types of TFTs constituting one stage of inverters are P, N, N, P, P, N, N, . . . , P, P, and N in FIG. 6 or FIG. 7 in order from the left. Accordingly, adjacent inverters in the same stage not only have the same channel region but also share a lead wire connected to the shared region. For example, the inverters 511 and 512 not only share a channel region of an N-channel type but also share a lead wire 602*a* connected to a drain region in the shared region. Also, for example, the inverters 522 and 523, which are adjacent, not only shares a channel region of a P-channel type but also shares a lead wire 601*a* connected to a source region in the shared region. In other words, so to speak, the inverters are arranged to be symmetrical around the lead wire 601*a* or 602*a*.

Figure 9:
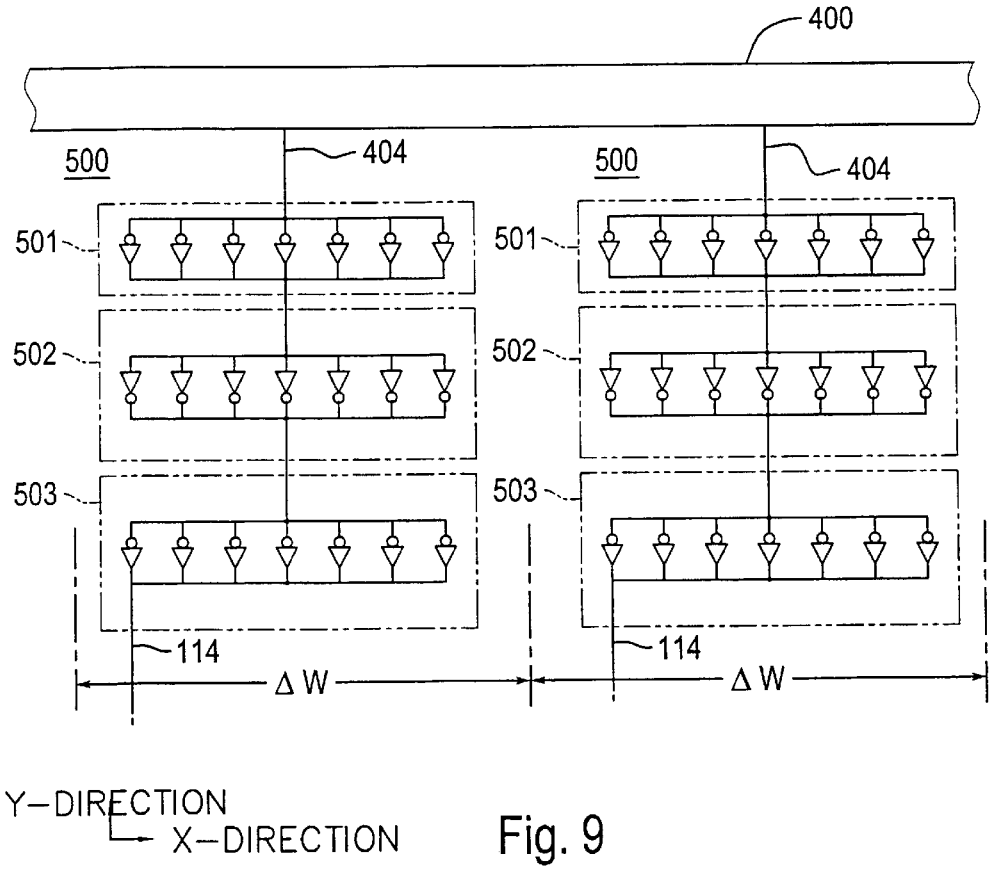
FIG. 9 is a block diagram showing an arrangement of the buffer circuit in the liquid crystal device.

Concerning each TFT constituting the inverters 511 to 517 in the first stage, a wire 404 that supplies a transfer signal whose pulse width is narrowed is provided extending in the form of comb teeth, whereby a gate electrode is formed. Wires connected to the source regions of P-channel TFTs constituting the inverters 511 to 517 in the first stage and to the drain regions of N-channel TFTs constituting the same are commonly connected as the outputs of the inverters 511 to 517 via contact holes, while being provided extending in the form of comb teeth so as to be used as the gate electrodes of TFTs constituting the inverters 521 to 527 in the second stage. Similarly, wires connected to the source regions of P-channel TFTs constituting the inverters 521 to 527 in the second stage and to the drain regions of N-channel TFTs constituting the same are commmonly used as the outputs of the inverters 521 to 527 via contact holes, while being provided extending in the form of comb teeth so as to be used as the gate electrodes of TFTs constituting the inverters 531 to 537 in the third stage. The source regions of the TFTs constituting the inverters 531 to 537 in the third stage and the drain regions of the TFTs constituting the same are commonly connected as the outputs of the inverters 531 to 537 via contact holes, whereby a sampling-control signal line 114 is formed. Each buffer circuit 500 as described above is provided so as to be arranged in the X-direction with a pitch corresponding to a total width (ΔW) of the twelve data lines 6*a* which are simultaneously driven and so as to correspond to the latch circuit 401 in the shift-register circuit 400, as shown in FIG. 9.

According to the above-described buffer circuit 500, one stage of inverter consists of a plurality of inverters connected in parallel. Thus, regions in which the X-direction is normally longitudinal are efficiently used, and the driving ability of the one stage of inverter can be enhanced. In addition, channel widths L1 to L3 of the TFTs constituting the inverters 501 to 503 increase step-by-step. Thus, the buffer circuits 500 can cope with a high load, and the number of sampling switches 302 that can simultaneously be driven can be increased.

Among inverters connected in parallel for one stage, adjacent inverters in the X-direction share P-channel regions or N-channel regions. Thus, compared with the case where a channel region is formed for each TFT, a substrate region is efficiently used. Also, since, in the shared channel regions, their drain regions or source regions are shared, lead wires from a power-supply wire can be shared.

In addition, the inverters 501 to 503 in the first stage to the third stage each comprise the same number of (seven) inverters connected in parallel, and complementary TFTs that constitute the inverters each have almost the same channel width (channel width differs depending on each stage). Thus, the inverters 511 to 517, 521 to 527, and 531 to 537 are arranged in the X-direction and the Y-direction in the form of a matrix. Accordingly, in a region, provided between the shift-register circuit 400 (the latch circuit 401 and the phase-adjusting circuit 402) and a plurality of video signal lines 115, which extends longitudinally in the X-direction, each inverter can efficiently be disposed, and lead wires from the power-supply wire can easily be shared by adjacent inverters in the Y-direction in different stages. For example, the lead wires 601*a* and 602*a* can be shared in the inverters 511, 521, and 531. Therefore, in this embodiment, the lead wires 601*a* and 602*a* are shared not only by adjacent inverters in the X-direction, as described above, but also by adjacent inverters in the Y-direction, so that the substrate region is efficiently used. Moreover, in this embodiment, size adjustment of a TFT constituting each inverter can be relatively facilitated. For example, adjustment of channel length can be performed by increasing or reducing the number of inverters connected in parallel in one stage, and adjustment of channel width can be performed by widening or narrowing the distance between the shift-register circuit 400 and the video signal lines 115. In particular, ease of adjusting channel width of a final-stage inverter determining the driving ability of the buffer circuit 500 is advantageous in device designing. Also, despite adjustment of TFT size, a plurality of inverters for one stage are connected in parallel in the X-direction, so that efficient use of the substrate region and improvement in the driving ability are achieved.

In the above-described buffer circuit 500, the number of direct stages of inverters is three, but another number may definitely be used. Similarly, in the above-described buffer circuit 500, the number of inverters in parallel in one stage is seven, but another number may definitely be used.

Figure 10:
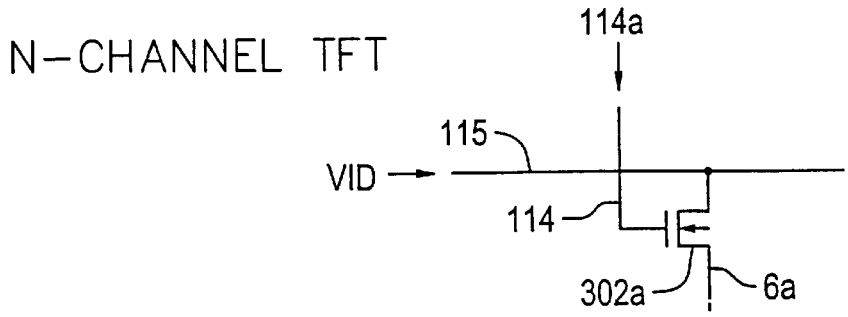
FIGS. 10(A)–10(C) consist of circuit diagrams showing the switch structure of a sampling circuit in the liquid crystal device.
Figure 10:
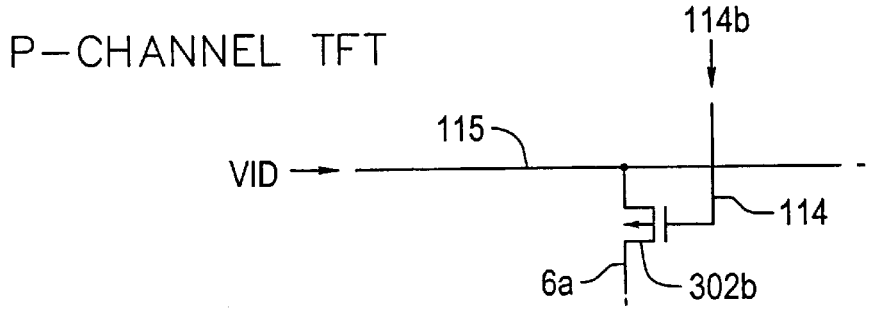
Figure 10:
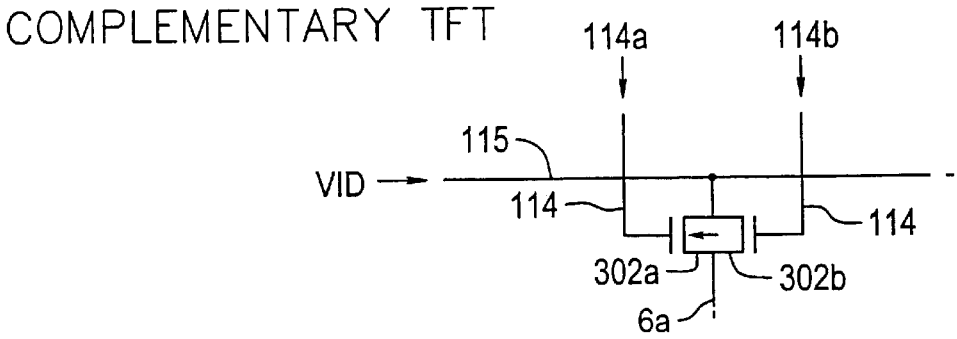

Referring to a specific example of each sampling switch 302 constituting the sampling circuit 301, a structure using an N-channel TFT 302*a* may be used, as shown in FIG. 10(A), a structure using a P-channel TFT 302*b* may be used, as shown in FIG. 10(B), and a structure using both the TFTs 302*a* and 302*b* as a complementary type may be used, as shown in FIG. 10(C). In the construction shown in FIG. 3, it is assumed that the N-channel TFT 302*a* shown in FIG. 10(A) is used. Accordingly, in the case where a P-channel TFT is used, it is required that a sampling-control signal 114*b* in which the level of the sampling-control signal 114*a* is inverted be generated. In the case where a complementary TFT is used, also signal lines for supplying the sampling-control signals 114*a* and 114*b* are required.

Each sampling switch 302 constituting the sampling circuit 301 preferably comprises an N-channel TFT, a P-channel TFT, or a complementary type of both types which is produced in a common process, with a TFT 30 in the pixel area.

As described above, according to this embodiment, the buffer circuit 500 has an arrangement in which the region of the TFT array substrate 10 is efficiently used. This not only enables size reduction of the whole liquid crystal device and enlargement of an image display region in the same sized device, but also enables high-definition image display adapted for a high-dot frequency.

Figure 11:
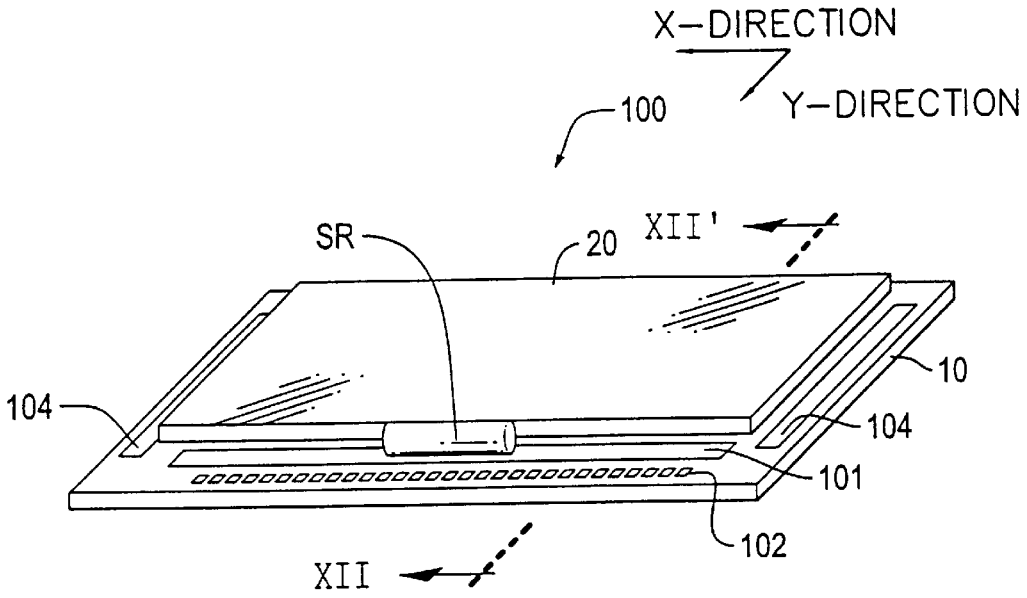
FIG. 11 is a perspective view showing a construction of the liquid crystal device.
Figure 12:
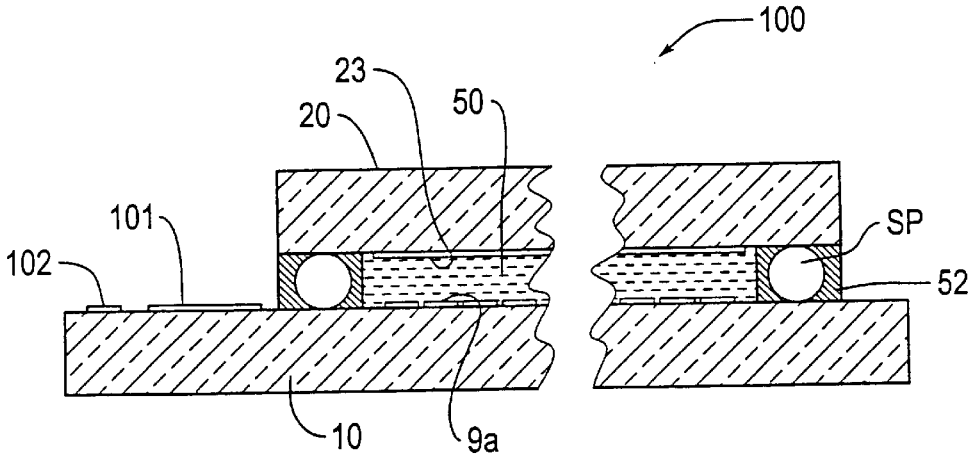
FIG. 12 is a partially sectional view illustrating the structure of the liquid crystal device.

Next, the overall construction of a liquid crystal device according to the above-described embodiment is described with reference to FIG. 11 and FIG. 12. FIG. 11 is a perspective view showing a construction of a liquid crystal device 100, and FIG. 12 is a sectional view on line XII—XII' in FIG. 11.

As shown in these figures, the liquid crystal device 100 has a structure in which a TFT-array substrate 10 composed of glass provided with pixel electrodes 9*a*, semiconductors, quartz, etc., and a transparent counter substrate 20 composed of glass provided with a counter electrode 23, etc., are joined by a sealing material 52 in which spacers SP are mixed, with a constant gap maintained, electrode-formed surfaces of both opposed to each other, and liquid crystal 50 as an electrooptical material provided in the gap. The sealing material 52 is formed along the periphery of the counter substrate 20, and part thereof is open so that the liquid crystal 50 is provided. Accordingly, after providing the liquid crystal 50, the open part is sealed by a sealing material SR.

On the counter surface of the TFT-array substrate 10, and along a one external side of the sealing material 52, a data-line driving circuit 101 and a sampling circuit 301 (omitted in FIG. 11 and FIG. 12) as described above are formed so that data lines 6*a* extending in the Y-direction are driven. Also, along the one side, a plurality of external circuit connecting terminals 102 are formed through which serial-to-parallel converted video signals VID1 to VID12 are input by an external circuit. Along two sides adjacent to the one side, two scanning-line-driving circuits 104 are formed so that scanning lines 3*a* extending in the X-direction are driven from the two sides. If a delay in scanning signals supplied to scanning lines 3*a* is not regarded as a problem, a structure forming only a scanning-line driving circuit 104 along either side may be employed. In addition, in the TFT-array substrate 10, a pre-charge circuit may be formed that pre-charges each data line 6*a* to a predetermined potential with timing before the sampling of the video signals in order to reduce a load of writing the video signals to each data line 6*a*.

In addition, the counter electrode 23 of the counter substrate establishes electric conduction with the TFT-array substrate 10 by a conduction material provided in at least one of four comers at junction portions. On the counter substrate 20, in accordance with uses of the liquid crystal device 100, for example, color filters arranged in a form, such as stripes, a mosaic, or a triangle, are firstly provided, and a light-shielding film is secondly provided that consists of a metallic material such as chromium or nickel, and resin black in which carbon or titanium, etc., is dispersed in a photoresist. For a color-light modulation use, a light shielding film is provided on the counter substrate 20, without forming the color filters. A backlight for emitting light to the liquid crystal device 10 is provided on the back of any one substrate.

In addition, on the opposed surfaces of the TFT-array substrate 10 and the counter substrate 20, alignment layers (illustration omitted) processed by rubbing in a predetermined direction, etc., are provided, and on the backs of substrates, polarizers (illustration omitted) in accordance with the alignment directions are provided. However, by using, as the liquid crystal 50, macromolecule-dispersed liquid crystal in which liquid crystals are dispersed as particles in high molecules, the need of the alignment layers and polarizers is eliminated. Accordingly, this is advantageous in that high luminance and low power consumption can be achieved because light-utilization efficiency is increased.

Instead of forming all or part of the peripheral circuits such as the driving circuit 200 on the TFT array substrate 10, for example, a construction may be employed in which a drive IC chip mounted on a film by using tape automated boding (TAB) is electrically and mechanically connected via an anisotropic film provided in a predetermined position on the TFT-array substrate 10, and a construction may be employed in which a drive IC chip itself is electrically and mechanically connected to a predetermined position on the TFT array substrate 10 via an anisotropic film by using COG(Chip On Grass) technique. Nevertheless, it is in the case where the driving circuit 200 is formed on the TFT-array substrate 10 that advantages by the liquid crystal device according to this embodiment are most strongly exhibited.

In addition, in the above-described embodiment, a transparent insulating substrate composed of glass, etc., is used as the TFT-array substrate 10 constituting the liquid crystal device, a silicon thin film is formed on the substrate, and TFTs constituting the switching devices (TFTs 30) and the driving circuit 200 for pixels are formed using TFTs each having a source, a drain, and a channel formed on the thin film. However, the present invention is not limited to the described embodiment.

For example, by using a semiconductor substrate to form the TFT-array substrate 10, and using insulated-gate field-effect transistors each having a source, a drain, and a channel formed on the surface of the semiconductor substrate, component devices for the switching devices (TFTs 30) and the driving circuit 200 for pixels may be formed. In the case where a semiconductor substrate is not used as the TFT-array substrate 10, it cannot be used as a transmissive type. Accordingly, by using aluminum or the like to form the pixel electrodes 9*a*, a reflective type device is made possible. Also, by using a transparent substrate as the TFT-array substrate 10, and using aluminum or the like to form the pixel electrodes 9*a*, a reflective type device may be formed.

In the above-described embodiment, the switching devices for pixels are three-terminal devices in which TFTs are commonest. However, the switching devices may be composed of two-terminal devices such as diodes. In the case where two-terminal devices are used as the switching devices for pixels, it is required that the scanning lines 3*a* be formed on one substrate, while the data lines 6*a* be formed on the other substrate, and that the two-terminal devices be formed between either the scanning lines 3*a* or the data lines 6*a* and the pixel electrodes 9*a*. In this construction, pixels comprise the pixel electrodes 9*a* to which the two-terminal devices are connected, signal lines (either the data lines 6*a* or the scanning lines 3*a*) formed on the counter substrate 20, and the liquid crystal 50 provided therebetween.

The present invention is not limited to an active-matrix liquid crystal device, but may be applied to a passive liquid crystal device using super twisted nematic (STN) liquid crystal. In this case, pixels comprise the scanning lines 3*a* operating as electrodes, the data lines 6*a* operating similarly as electrodes, and the liquid crystal 50 provided therebetween.

In addition, the present invention may be applied to a display device that uses, other than liquid crystal, a electroluminescent device as the electrooptical material, and that performs display using its electrooptic effects. In other words, the present invention may be applied to all electrooptical devices having a construction similar to that of the above-described liquid crystal device.

Figure 13:
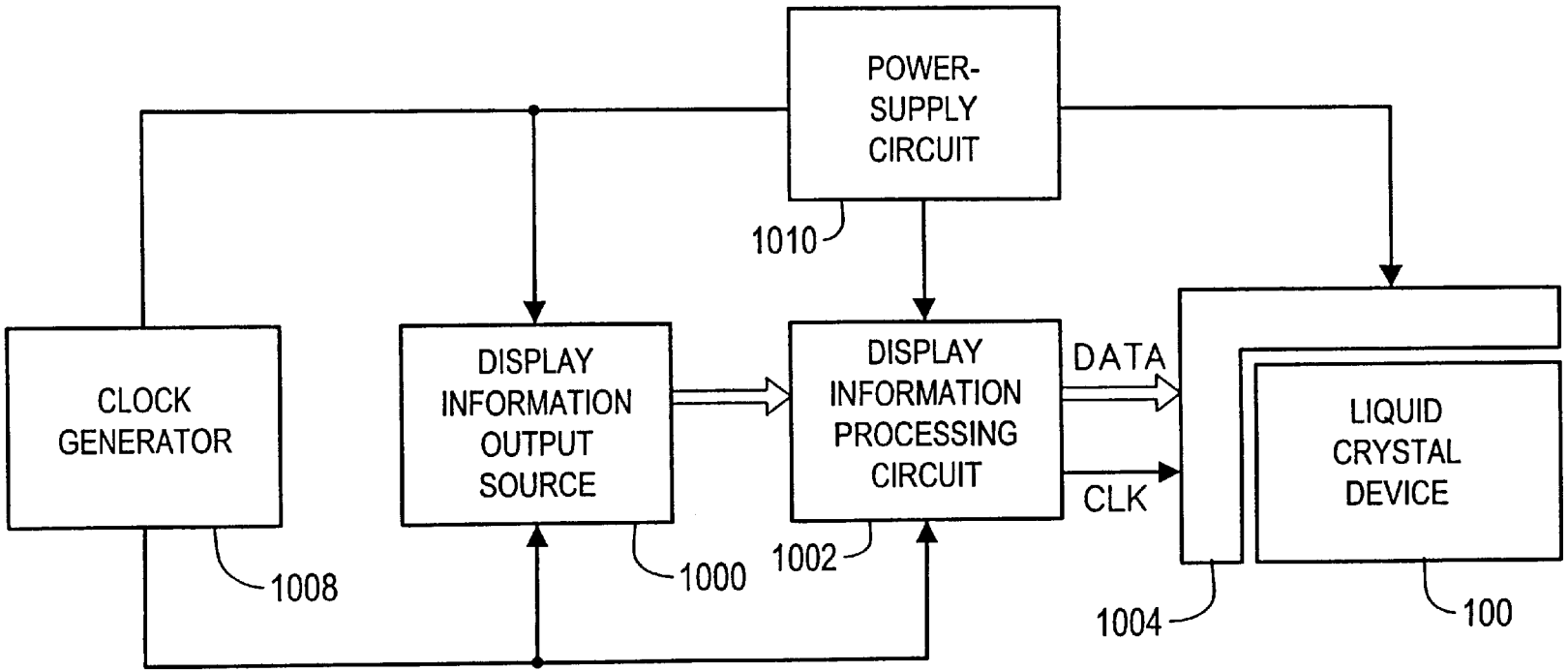
FIG. 13 is a block diagram showing a schematic construction of an electronic apparatus to which the liquid crystal device is applied.

Next, cases in which the above-described liquid crystal device is applied to types of electronic apparatuses are described. In this case, as shown in FIG. 13, an electronic apparatus mainly includes a display-information output source 1000, a display-information processing circuit 1002, a driving circuit 1004, a liquid crystal device 100, a clock-generating circuit 1008, and a power-supply circuit 1010. Among these, the display-information output source 1000 includes a memory such as a read-only memory (ROM) or a random-access memory (RAM), a storage unit such as an optical disk unit, and a tuned circuit for outputting video signals in accordance with tuning, and outputs, based on a clock signal from the clock-generating circuit 1008, information such as video signals having a predetermined format to the display-information processing circuit 1002. The display-information processing circuit 1002, which includes various processing circuits such as a serial-to-parallel conversion circuit as described above, an amplifying-and-polarity-inversion circuit, a rotation circuit, a gamma correction circuit, and a clamp circuit, sequentially generates digital signals from display information input based on a clock signal, and outputs them to the driving circuit 1004, together with a clock signal CLK. The driving circuit 1004 drives the liquid crystal device 100, and includes an inspection circuit used for inspection after fabrication, other than the above-described driving circuit 200. The power-supply circuit 1010 supplies predetermined power to each of the above-described circuits.

Next, examples in which the above-described liquid crystal device is used in specific electronic apparatuses are described.

Figure 14:
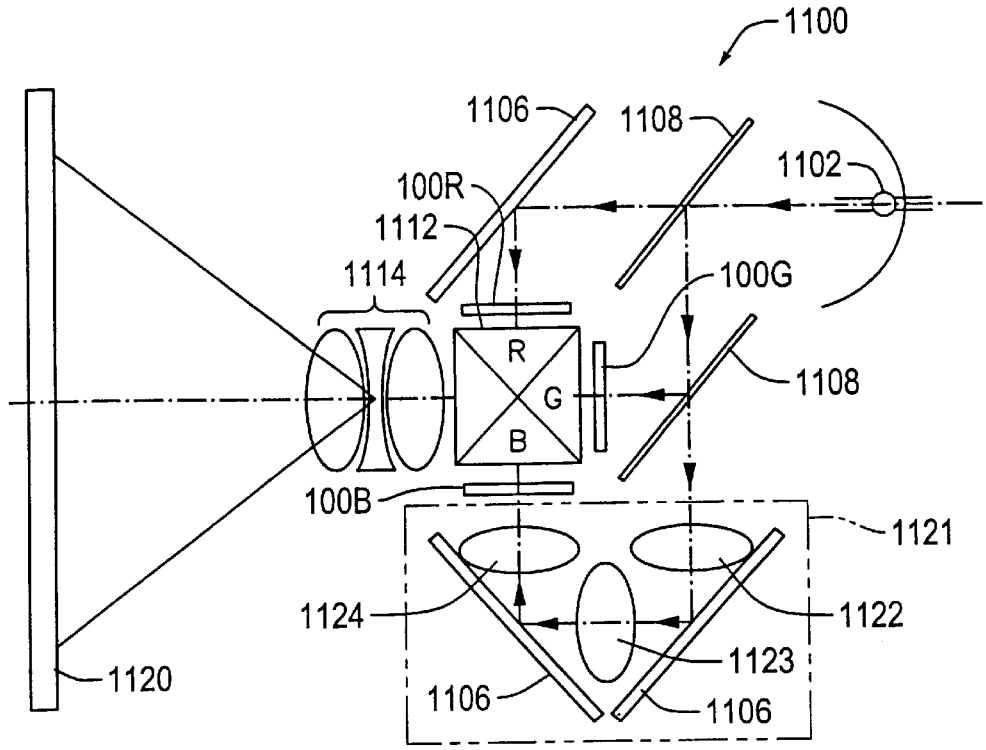
FIG. 14 is a sectional view showing a construction of a projector as an embodiment of an electronic apparatus to which the liquid crystal device is applied.

First, a projector in which the liquid crystal device 100 is used as a light bulb is described. FIG. 14 is a plan view showing a construction of the projector. As shown in this figure, inside the projector 1100, a lamp unit 1102 including a white light source such as a halogen lamp is provided. A projected ray emitted from the lamp unit 1102 is separated into three primary colors, red, green, and blue by three mirrors 1106 and two dichroic mirrors 1108, which are internally provided, and the separated rays are led to light bulbs 100R, 100G, and 100B corresponding to the primary colors.

Each construction of the light bulbs 100R, 100G, and 100B is similar to that of the above-described liquid crystal device 100, and are respectively driven by red (R), green (G), and blue (B) primary-color signals supplied from a video-signal processing circuit (not shown). The B-color ray is led via a relay lens system 1121 including an incident lens 1122, a relay lens 1123, and an emitting lens 1124 so that a loss is prevented since its optical path is longer compared with the other R-color and G-color.

The rays modulated by the light bulbs 100R, 100G, and 100B are incident on a dichroic prism 1112 from three directions. The dichroic prism 1112 refracts the R-color and B-color rays at 90 degrees, while allowing the G-color ray to travel straight. Accordingly, as a result of combination of images in the colors, a color image is projected onto a screen 1120 via a projection lens 1114.

Since the dichroic mirror 1108 causes rays corresponding to the primary colors to be incident on the light bulbs 100R, 100G, and 100B, it is not necessary to provide a color filter, as described above.

Figure 15:
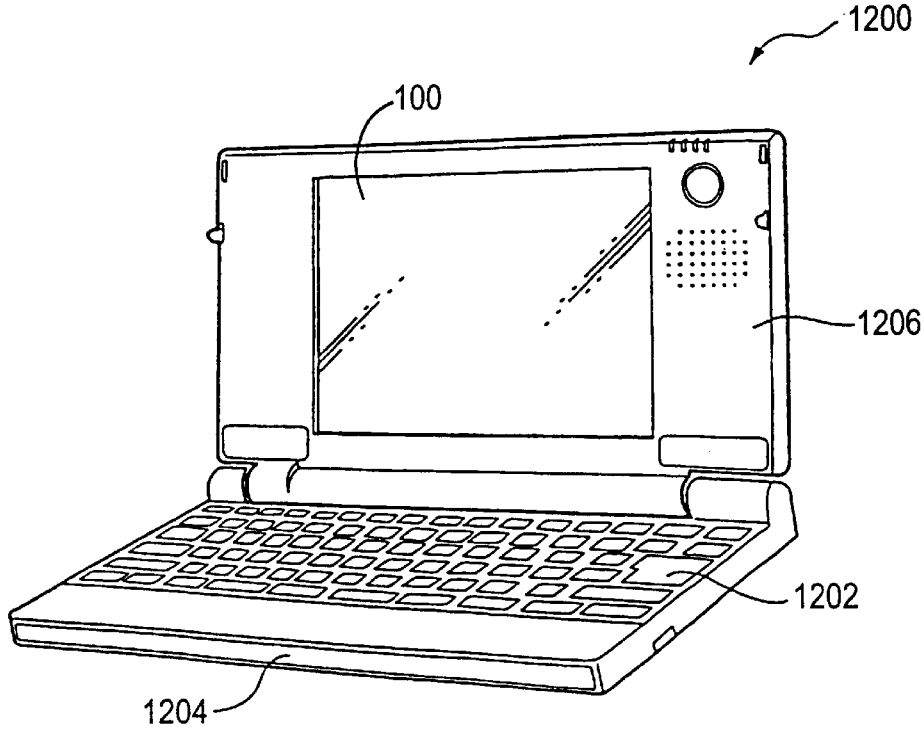
FIG. 15 is a perspective view showing a construction of a personal computer as an embodiment of an electronic apparatus to which the liquid crystal device is applied.

Next, an example in which the liquid crystal device is applied to a mobile personal computer is described. FIG. 15 is a perspective view showing a construction of the personal computer. In this figure, a computer 1200 includes a main unit 1204 provided with a keyboard 1202, and a liquid-crystal display unit 1206. The liquid-crystal display unit 1206 is formed by providing a backlight on the back of the above-described liquid crystal device 100.

The electronic apparatuses include not only the ones described referring to FIG. 14 and FIG. 15 but also a liquid-crystal television set, a videotape recorder with a view finder or with a direct-view monitor, a car navigation apparatus, a pager, an electronic pocketbook, an electronic calculator, a word processor, a work station, a portable telephone, a videophone, a POS terminal, an apparatus with a touch panel. Definitely, the liquid crystal device of the embodiment and an electrooptic device may be applied to the electronic apparatus of various types.

As described above, according to the present invention, in an electrooptical device such as a liquid crystal device with built-in driving circuits, which simultaneously drives data lines, the size of the entire device can be reduced, efficiently using a substrate region.

What is claimed is:

1. A driving circuit for an electrooptical device, comprising:

a scanning line above a substrate;

a data line above the substrate;

a switching device that supplies a pixel electrode with video signals from the data line in response to a signal of the scanning line;

a shift-register circuit that includes a plurality of latch circuits for sequentially outputting transfer signals;

a plurality of buffer circuits that correspond to output stages of the shift-register circuit, the buffer circuits each including a plurality of inverter logic circuits connected in parallel along a direction intersecting a direction in which the data line extends, the buffer circuits outputting the transfer signals as sampling-control signals; and a plurality of sampling switches connected to a plurality of the data lines, the sampling switches sampling video signals in accordance with the sampling-control signals, and supplying the sampled signals to the corresponding data lines, among which a plurality of sampling switches connected to a plurality of adjacent data lines are simultaneously driven.

2. The driving circuit for an electrooptical device as set forth in claim 1, the logic circuits including transistors having a channel-width direction formed along the direction in which the plurality of data lines extend.

3. The driving circuit for an electrooptical device as set forth in claim 2, two adjacent logic circuits among the plurality of logic circuits connected in parallel sharing one of a plurality of power-supply wires.

4. The driving circuit for an electrooptical device as set forth in claim 1 ,the plurality of buffer circuits each being formed by connecting in series along the direction in which the data lines extend, a plurality of logic circuits connected in parallel so as to have a plurality of stages.

5. The driving circuit for an electrooptical device as set forth in claim 4, a channel width of transistors included in the logic circuits in one stage are broader than a channel width of transistors included in the logic circuit in the previous stage.

6. The driving circuit for an electrooptical device as set forth in claim 5, the numbers of logic circuits connected in parallel in all the stages being equal.

7. The driving circuit for an electrooptical device as set forth in claim 6, among the logic circuits in all the stages, logic circuits in the same stage mutually sharing power-supply wires formed in the direction in which the data lines extend.

8. The driving circuit for an electrooptical device as set forth in claim 1, the plurality of logic circuits comprising a complementary transistor.

9. The driving circuit for an electrooptical device as set forth in claim 1, further comprising a phase-adjusting circuit which restricts the signal width of the transfer signal from one of the plurality of latch circuits to a predetermined period and which supplies the restricted signal to one of the plurality of buffer circuits.

10. The driving circuit for an electrooptical device as set forth in claim 1, plurality of video-signal lines that supply video signals being arranged along the plurality of scanning lines on the substrate.

11. The driving circuit for an electrooptical device as set forth in claim 10, the buffer circuits being formed in the substrate region between the plurality of video-signal lines and the shift-register circuit.

12. The driving circuit for an electrooptical device as set forth in claim 11, the video signals being serial-to-parallel converted and supplied via the plurality of video-signal lines.

13. An electrooptical device, comprising:

the driving circuit as set forth in claim 1.

14. The electrooptical device as set forth in claim 13, the logic circuits including transistors having a channel-width direction formed along the direction in which the plurality of data lines extend.

15. The electrooptical device as set forth in claim 14, two adjacent logic circuits among the plurality of logic circuits connected in parallel sharing one of a plurality of power-supply wires.

16. The electrooptical device as set forth in claim 13, the plurality of buffer circuits each being formed by connecting in series along the direction in which the data lines extend, a plurality of logic circuits connected in parallel so as to have a plurality of stages.

17. The electrooptical device as set forth in claim 16, a channel width of transistors included in the logic circuits in one stage are broader than a channel width of transistors included in the logic circuit in the previous stage.

18. The electrooptical device as set forth in claim 17, the numbers of logic circuits connected in parallel in all the stages being equal.

19. The electrooptical device as set forth in claim 18, among the logic circuits in all the stages, logic circuits in the same stage mutually sharing power-supply wires formed in the direction in which the data lines extend.

20. The electrooptical device as set forth in claim 13, the plurality of logic circuits comprising a complementary transistor.

21. The electrooptical device as set forth in claim 13, further comprising a phase-adjusting circuit which restricts the signal width of the transfer signal from one of the plurality of latch circuits to a predetermined period and which supplies the restricted signal to one of the plurality of buffer circuits.

22. The electrooptical device as set forth in claim 13, a plurality of video-signal lines that supply video signals being arranged along the plurality of scanning lines on the substrate.

23. The electrooptical device as set forth in claim 22, the buffer circuits being formed in the substrate region between the plurality of video-signal lines and the shift-register circuit.

24. The electrooptical device as set forth in claim 23, the video signals being serial-to-parallel converted and supplied via the plurality of video-signal lines.

25. An electrooptical device as set forth in claim 12, wherein the pixel electrodes are arranged in the form of a matrix, and transistors are provided between the pixel electrodes and the data lines, the transistors being switched on and off in accordance with scanning signals supplied to the scanning lines.

26. An electronic apparatus, comprising:

the electrooptical device as set forth in claim 13.

27. The driving circuit for an electrooptical device according to claim 1, the plurality of logic circuits arranged between sampling-control signal lines for supplying the sampling-control signals.

28. The driving circuit for an electrooptical device according to claim 1, wherein the logic circuit is an inverter logic circuit.

* * * * *